US010072384B2

(12) United States Patent
McDonald

(10) Patent No.: US 10,072,384 B2
(45) Date of Patent: Sep. 11, 2018

(54) CONCRETE PLATE AND SLEEVE DOWEL DEVICE WITH ALIGNMENT SURFACES

(71) Applicant: Stephen F. McDonald, Hertford, NC (US)

(72) Inventor: Stephen F. McDonald, Hertford, NC (US)

(73) Assignee: McTech Group, Inc., Hertford, NC (US)

( * ) Notice: Subject to any disclaimer, the term of this patent is extended or adjusted under 35 U.S.C. 154(b) by 0 days.

(21) Appl. No.: 15/426,865

(22) Filed: Feb. 7, 2017

(65) Prior Publication Data

US 2017/0145641 A1 May 25, 2017

Related U.S. Application Data

(62) Division of application No. 14/160,609, filed on Jan. 22, 2014, now Pat. No. 9,574,309.

(51) Int. Cl.
*E01C 11/14* (2006.01)
*E04B 1/48* (2006.01)

(52) U.S. Cl.
CPC ..... *E01C 11/14* (2013.01); *E04B 1/48* (2013.01); *E04B 1/483* (2013.01)

(58) Field of Classification Search
CPC ..... E01C 11/02; E01C 11/06; E01C 11/14
USPC ..... 404/47, 51, 57, 58, 60; 52/396.04
See application file for complete search history.

(56) References Cited

U.S. PATENT DOCUMENTS 2,419,022 A * 4/1947 Heltzel ..... E01C 11/14 404/59
2,476,243 A * 7/1949 Heltzel ..... E01C 11/14 404/61
4,531,564 A * 7/1985 Hanna ..... E04L 32/7405 160/229.1
5,730,544 A * 3/1998 Dils ..... F16B 12/04 403/13
6,145,262 A * 11/2000 Schrader ..... E01C 11/14 404/52

(Continued)

OTHER PUBLICATIONS

QuicPlate Flat Plate Dowel System—BoMetals, Inc., www.http://bometals.com/products/joints/dowels/flat-plate-dowel-system, Apr. 12, 2012.

*Primary Examiner* — Thomas B Will
*Assistant Examiner* — Katherine J Chu
(74) *Attorney, Agent, or Firm* — Mehrman Law Office; Michael J. Mehrman

(57) ABSTRACT

A concrete dowel device including a sleeve and plate in which the sleeve includes break-away alignment tabs at the opening of the sleeve to ensure proper alignment of the plate within the sleeve during field installation. The tabs are positioned at the sleeve opening, rather than along the length of the socket, to avoid misalignment of the plate in the sleeve, simplify use and reduce manufacturing costs of the product. The sleeve and plate may include additional alignment surfaces on the plate, at the rear corners, or along the rear side of the plate and sleeve. To facilitate manufacturing, the break-away alignment tabs may be formed as molded components rotated and snapped into position. Alternatively, the break-away alignment tabs may be formed as part of an insert plate manufactured apart from and attached to the flange of the sleeve.

10 Claims, 6 Drawing Sheets

(56) References Cited

U.S. PATENT DOCUMENTS 6,354,760 B1 * 3/2002 Boxall ..... E01C 11/14 404/47
6,502,359 B1 * 1/2003 Rambo ..... E01C 11/14 249/9
6,523,382 B1 * 2/2003 Dimig ..... C23C 16/455 70/419
6,533,391 B1 * 3/2003 Pan ..... H01L 23/544 257/778
6,926,463 B2 * 8/2005 Shaw ..... E01C 11/14 404/58
7,004,443 B2 * 2/2006 Bennett ..... E01C 11/14 249/177
7,441,985 B2 * 10/2008 Kelly ..... E01C 11/14 404/56
7,604,432 B2 * 10/2009 Shaw ..... E01C 19/504 404/58
7,736,088 B2 * 6/2010 Boxall ..... E01C 11/14 249/9
7,748,928 B2 * 7/2010 Estes ..... E01C 11/14 404/58
8,465,222 B1 * 6/2013 Ghauch ..... E01C 11/14 404/51
8,468,766 B1 * 6/2013 Keenan ..... E04B 5/023 403/270
8,672,579 B2 * 3/2014 Laiho ..... E01C 11/14 404/47
2007/0196170 A1 * 8/2007 McDonald ..... E01C 11/14 404/37
2007/0231068 A1 * 10/2007 Francies ..... E01C 11/14 404/56
2010/0054858 A1 * 3/2010 Mayo ..... E01C 11/14 404/56
2010/0111599 A1 * 5/2010 Baur ..... B23C 3/30 403/350
2013/0219806 A1 * 8/2013 Carrubba ..... E04F 15/02033 52/58

* cited by examiner

CONCRETE PLATE AND SLEEVE DOWEL DEVICE WITH ALIGNMENT SURFACES

REFERENCE TO RELATED APPLICATION

This application claims priority to U.S. application Ser. No. 14160609 filed Jan. 22, 2014 scheduled to grant on Feb. 21, 2017 as U.S. Pat. No. 9,574,309, which is incorporated herein by reference.

TECHNICAL FIELD

The present invention relates to concrete dowel devices and, more particularly, to a plate and a sleeve concrete dowel device with break-away alignment tabs.

BACKGROUND

Concrete dowels are embedded into joints between adjacent slabs of concrete to prevent vertical displacement between the slabs to maintain a smooth pavement surface and increase the strength of the concrete in the region of the joint. While the dowels are provided to prevent excessive vertical displacement between the slabs, they are typically designed to allow a small amount of horizontal separation and lateral displacement between the slabs to relieve internal stress to accommodate drying shrinkage and thermal expansion and contraction of the slabs. This permits a normal amount of slab movement to prevent excessive cracking while still maintaining a smooth top surface of the pavement.

Traditionally, two foot lengths of rebar rods were used as the concrete dowels. But rod dowels tend to cause cracking in the concrete due to concentration of the stress on the relatively small surface area of the rods. Concrete dowels configured as larger bars and load plates were therefore developed to reduce cracking by increasing the surface area of the dowel. In comparison to rebar rods historically used as concrete dowels, larger dowel bars and plates provide a flat and significantly increased dowel surface area to improve the dowel's load transfer capability and reduce the tendency of cracking to form at the dowel location. U.S. Pat. No. 6,354,760 and U.S. patent application Ser. No. 11/109,781 describe examples and the benefits of this approach.

To assist in embedding the dowels within adjacent slabs of concrete while the concrete is being poured, dowel devices including dowel bars (or plates) and sleeves have been developed. U.S. Pat. No. 6,145,262 describes this approach. The sleeved dowel bar has the benefit of permitting the bar to slide within the sleeve to accommodate a small amount of horizontal separation between the slabs to relieve internal stress. To accommodate lateral displacement between the slabs the sleeve is a little bit wider than the bar, which allows the bar to move laterally within the sleeve after the concrete slabs have cured. But simply making the sleeve wider than the bar removes positive registration between the bar and sleeve making it difficult to determine when the bar has been properly centered within the sleeve. As a result, construction workers have to install the bars carefully to ensure the proper spacing on either side of the plate within the sleeve, which can be a lot to ask of construction workers in some setting. To solve this problem, the sleeve described in U.S. Pat. No. 6,145,262 contains fins along the side walls of the sleeve to help align the dowel bar within the sleeve.

However, providing dowel sleeves with elongated fins along the interior side walls is an expensive solution. Including the fins along the internal surfaces of the sleeve complicates the manufacturing process and can require multiple molds to create the sleeve. Although a structure containing the fins may be manufactured separately and inserted into to the sleeve after the sleeve has been molded, this significantly complicates the manufacturing process and increases the cost of the dowel. For example, manual assembly steps may be required to insert and secure the fins within the sleeve.

In addition, even when fins are included, it is still possible with prior sleeved dowel devices to install the bar on a slant deflecting the fins prior to pouring the concrete slabs, which can reduce or eliminate the effectiveness of the fins. A plate installed on an angle within the sleeve with the fins deflected before the concrete is poured reduces or eliminates the lateral play that the dowel was designed to allow. With this system, it can also be difficult for the construction workers in the field to see whether the fins have been deflected when the plate is inserted, leading to some portion of the plates being installed without proper alignment within the sleeves.

As a result, there is a persistent need for a lower cost and more reliable concrete dowel solution and, more particularly, a need for a concrete dowel device to ensure proper registration of the plates within the sleeves without requiring cumbersome manufacturing or assembly procedures.

SUMMARY OF THE INVENTION

The present invention meets the needs described above in a concrete dowel device including a sleeve and plate in which the sleeve includes break-away alignment tabs at the opening of the socket to ensure proper alignment of the plate within the sleeve during field installation. The tabs are positioned at the sleeve opening, rather than along the length of the socket, to avoid misalignment of the plate within the sleeve, simplify use and reduce the manufacturing costs of the product. The plate may have a tiered structure to enhance registration between the place and sleeve. Alternatively or additionally, the sleeve and plate may include additional alignment surfaces at the rear corners or along the rear side of the plate and sleeve. For example, slanted corners and/or a "V" shaped groove can be provided to assist in properly aligning the plate within the sleeve.

To facilitate manufacturing, the break-away alignment tabs may be formed as molded components of the sleeve, which are rotated and snapped into position after the sleeve has been molded. Alternatively, the break-away alignment tabs may be formed as part of an insert plate that is molded separately and attached to the flange of the sleeve after the sleeve has been molded. Both approaches allow the sleeve (without the insert plate) to be molded as a single part without the need to insert fins or another alignment structure along the side walls of the sleeve.

In view of the foregoing, it will be appreciated that the present invention provides an improved plate and a sleeve concrete dowel device with break-away alignment tabs. The specific structures and techniques for accomplishing the advantages described above will become apparent from the following detailed description of the embodiments and the appended drawings and claims.

DETAILED DESCRIPTION OF THE EMBODIMENTS

Figure 1B:
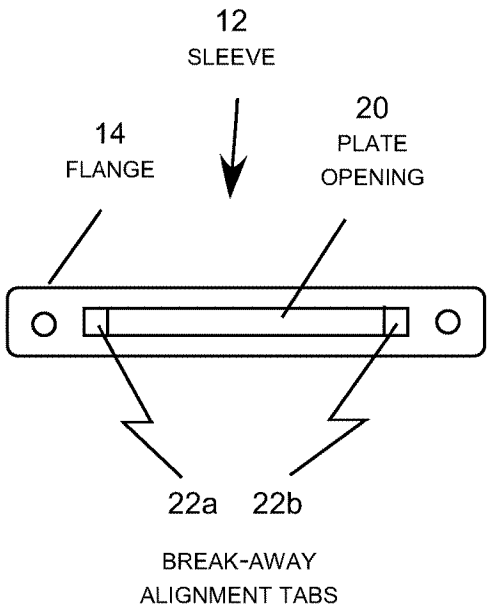
FIG. 1B is a front view of the sleeve showing the break-away alignment tabs before insertion of the plate into the sleeve.

The present invention may be embodied in a concrete dowel device, a method for constructing concrete structures using the concrete dowel devices, and concrete structures that include embedded concrete dowel devices. The innovative concrete dowel represents a significant improvement over the concrete dowel approaches shown in U.S. Pat. Nos. 6,354,760; 6,145,262; 4,733,515 and 8,454,265, which are incorporated by reference.

The concrete dowel device includes a sleeve and plate configured for use with a concrete form typically constructed with wooden boards. The dowels are embedded at the joints between adjacent concrete slabs to provide vertical support to keep the surface of the concrete level while allowing a small amount of horizontal and lateral movement to accommodate thermal expansion of the slabs while curing and during normal use, vibration, and other normal types of movement between adjacent concrete slabs. Providing for this type of relative movement between the slabs relieves stress to prevent or reduce cracking in the concrete during normal use while maintaining a smooth top surface of the pavement at the joints.

The concrete dowel accommodates a small amount of movement of the slabs away and towards each other transverse to the joint as well as lateral displacement between the slabs in the direction of the joint, while preventing substantial vertical movement to maintain a smooth, level surface at the joint between the concrete slabs. An improvement resides in the break-away tabs positioned at the opening of the sleeve to guide insertion of the plate into the sleeve during construction without inhibiting normal lateral movement between the slabs after they have cured. Additional guide structures, such as slanted corners ore a "V" groove in the sleeve and plate may provide additional guide structures to ensure proper registration of the plate within the sleeve. In the embodiment shown in FIG. 6, for example, the sleeve defines a rear socket wall including a "V" shaped indentation toward the opening of the socket, while the plate includes a corresponding "V" shaped indentation configured for mating engagement with the indentation of the rear socket wall. The mating engagement of the indentations helps to properly align the plate in the socket when the plate is pushed into the sleeve.

The sleeve is designed to be nailed to a wooden form defining the edge of the first slab (one side of the joint between adjacent slabs) where a dowel is desired prior to pouring the first slab. The first slab is then poured with the sleeve held in place by the form, which embeds the sleeve within the first slab. Once the first slab has set sufficiently, the form is removed and the plate is inserted into the sleeve so that about half the plate extends into the sleeve and half extends into the area where the second concrete slab is to be poured. The second slab is then poured with the plate held in place by the sleeve. Once the second slab sets, the dowel formed by the sleeve and plate is embedded into the joint between the slabs, while the plate can slide a small amount within the sleeve to accommodate horizontal separation and lateral displacement between the slabs while maintaining the slabs in vertical alignment.

The present invention includes break-away alignment tabs positioned at opposing sides of the opening to the socket of the sleeve. The alignment tabs remain in place during slab construction to guide proper alignment of the plate with the sleeve. The tabs are configured to break away as forced by relative movement of the concrete slabs after the concrete has cured to allow a small amount of displacement between adjacent slabs. Various embodiments include additional alignment mechanism, such as angled corners and a "V" groove along the rear side of the sleeve, with corresponding guide surfaces in the plate, to facilitate proper registration between the sleeve and the plate.

Figure 1A:
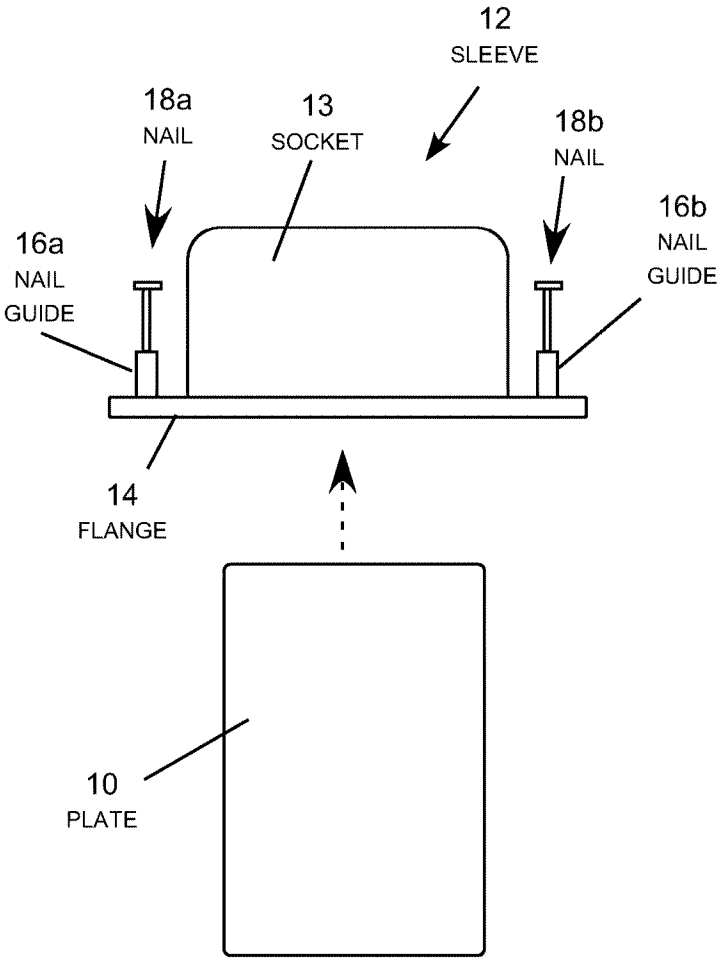
FIG. 1A is a top view of a plate and sleeve concrete dowel device with the plate positioned outside the sleeve.

Turning now to the figures, FIG. 1A is a top view of a plate 10 and sleeve 12 forming a concrete dowel device with the plate positioned outside the sleeve. The sleeve 12 includes a socket 13 configured to snugly receive the plate 10 and typically includes ridges, dimples or other internal surface features to ensure a snug interference fit between the plat and the socket. The sleeve 12 also includes a flange 14 at the opening of the socket 13 that includes two nail guides 16*a-b* that typically support two pre-installed nails 18*a-b* positioned ready for nailing into a wooden form.

Figure 2B:
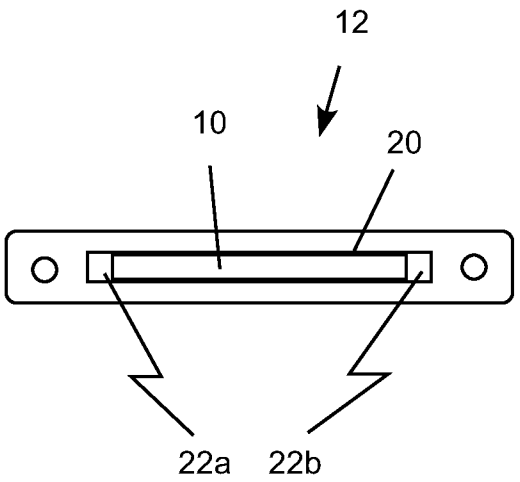
FIG. 2B is a front view of the sleeve showing the break-away alignment tabs with the plate inserted within the sleeve.
Figure 2A:
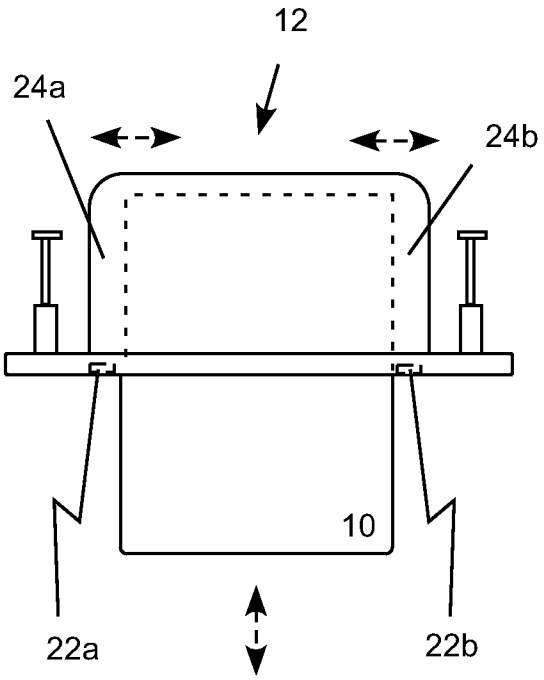
FIG. 2A is a top view of a plate and sleeve concrete dowel device with the plate inserted within the sleeve.

FIG. 1B is a front view of the sleeve 12 showing the flange 14 defining a plate opening 20 flanked by two break-away alignment tabs 22*a-b* before insertion of the plate into the sleeve. FIG. 2A is a top view of a plate and sleeve concrete dowel device with the plate 10 inserted within the sleeve 12. FIG. 2B is a front view of the sleeve 12 showing the break-away alignment tabs 22*a-b* with the plate inserted within the opening 20 of the sleeve, as guided by the alignment tabs to center the plate within the sleeve. The socket of the sleeve is a bit wider than the plate to accommodate some lateral movement of the plate within the sleeve after the concrete slabs have set, and the break-away alignment tabs are provided to facilitate proper centering of plate within the sleeve during construction of the concrete slabs. For example, the plate may be about eight inches wide and the socket in the range of about nine inches wide. The break-away alignment tabs are attached sufficient strongly to the flange to remain in place during construction, but are thinner than the rest of the sleeve, have thinner seams, are scored or interference fit in place to break away after the concrete has set to accommodate lateral movement between the concrete slabs joined by the dowel. The interference fit between the plate and the sleeve accommodates a bit of horizontal separation between the concrete slabs as wells as lateral displacement while maintaining smooth vertical alignment of the top surface of the slabs.

Figure 3C:
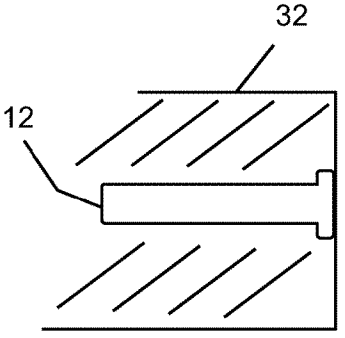
FIG. 3C is a cross-section plan view of the sleeve embedded within the first concrete slab after the first slab has set and the form has been removed.
Figure 3B:
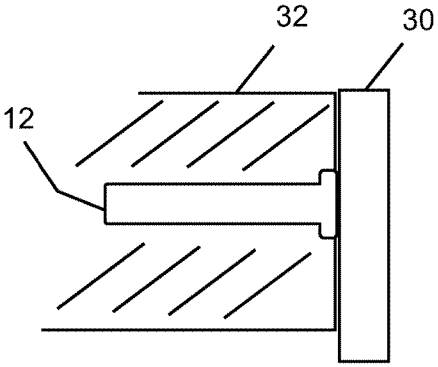
FIG. 3B is a cross-section plan view of the sleeve nailed to a concrete form after the first concrete slab has been poured over the sleeve.
Figure 3A:
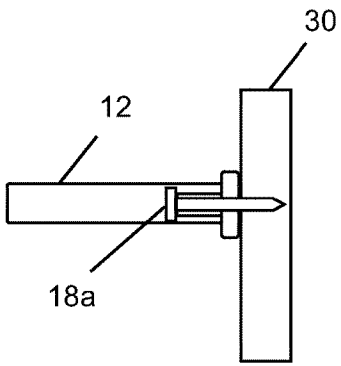
FIG. 3A is a plan view of the sleeve nailed to a concrete form before pouring of a first concrete slab over the sleeve.
Figure 3E:
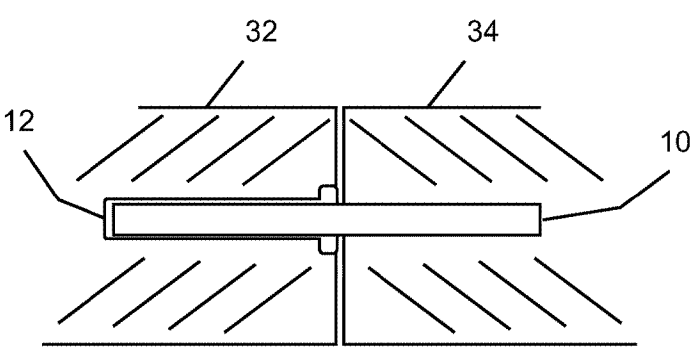
FIG. 3E is a cross-section plan view of the dowel formed by the sleeve and plate embedded at the joint between the first and second concrete slabs.
Figure 3D:
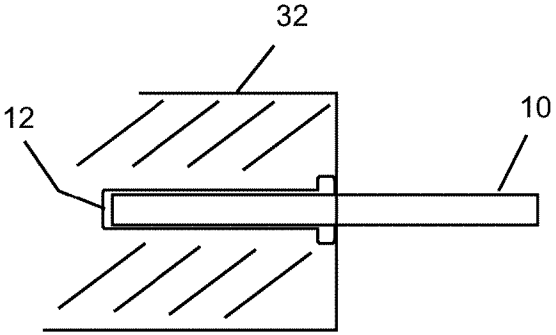
FIG. 3D is a cross-section plan view of the sleeve embedded within the first concrete slab after the plate has been inserted into the sleeve.

FIGS. 3A-E illustrate use of the dowel during construction of the concrete structure, such as a pavement. Many dowels are used in a typical pavement project and the figures depict a representative dowel. FIG. 3A is a plan view of the sleeve 12 nailed to a concrete form 30 before pouring of a first concrete slab over the sleeve. The nail 18*a* is typically pre-installed allowing the construction worker to easily nail the sleeve to the form in the desired position with a few hammer strikes. As shown in FIG. 3B, once the dowel has been nailed in place on the form, the first slab 32 is poured, which embeds the sleeve 12 within the first slab 32. Once the first slab has set, the form 30 is removed as shown in FIG. 3C. This exposes the socket opening of the sleeve at the edge of the first concrete slab. A construction worker then inserts the plate 10 into the sleeve 12 as shown in FIG. 3D. It is at this point when the alignment tabs assist the construction worker to properly align the plate 10 within the sleeve 12 to ensure that the dowel accommodates the desired amount of lateral movement. It will be appreciated that dowel will not function as designed if the plate is not aligned properly in the center of the sleeve and construction worker are prone to work hastily with variable levels of attention. The alignment tabs do a good job of squaring the plate within the sleeve when the plate is jammed into the sleeve, for example when a worker pushes or hits the plate with a board, hammer, hand or foot. The second slab 34 is then poured as shown in FIG. 3E leaving the dowel formed by the sleeve and plate embedded at the joint between the first and second slabs.

Figure 4B:
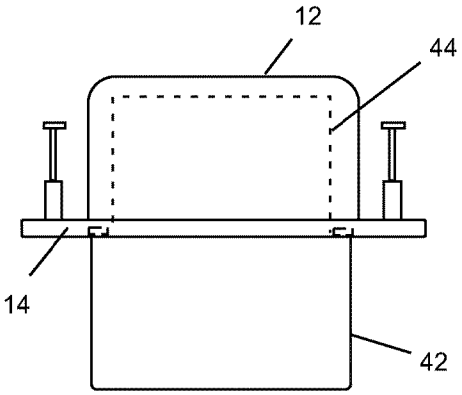
FIG. 4B is a top view of the first alternative concrete dowel device with the plate inserted within the sleeve.
Figure 4A:
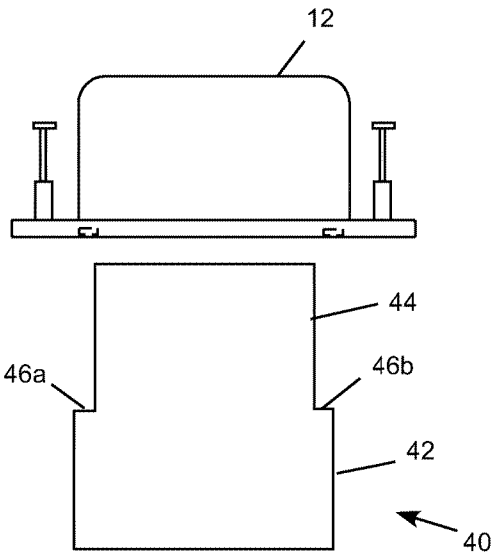
FIG. 4A is a top view of a first alternative concrete dowel device with the plate located outside the sleeve.
Figure 4C:
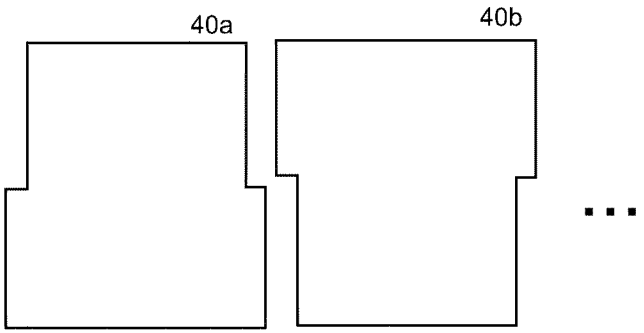
FIG. 4C is a top view illustrating a waste-free approach for stamping the plated for the first alternative concrete dowel device from sheet stock material.

It will be appreciated that ensuring proper registration between the plate and sleeve is of primary importance when installing the dowels. Several alternatives may be utilized to further ensure proper registration and, once these techniques are understood, other variations will become apparent to those skilled in the art. FIGS. 4A-C show a first alternative designed to ensure proper registration, which includes a plate 40 that has a wider portion 42 designed to remain outside the sleeve and a narrower portion 44 designed to be fully inserted into the sleeve. When the plate is fully inserted into the sleeve, transition edges 46*a-b* between the wider and narrower portions are designed to bottom out against the flange 14 providing a visual and physical indication of positive registration of the plate in the sleeve. Basically, this allows the construction worker to hand push, kick, or hit the plate with a board or hammer until the transition edges 46*a-b* of the plate are flush against the flange 14. A quick visual inspection will confirm that all of the plates are properly installed. As shown in FIG. 4C, the wider and narrower portions 42, 44 can have the same depth so that the plates can be formed (typically stamped) from sheet stock without waste.

Figure 6:
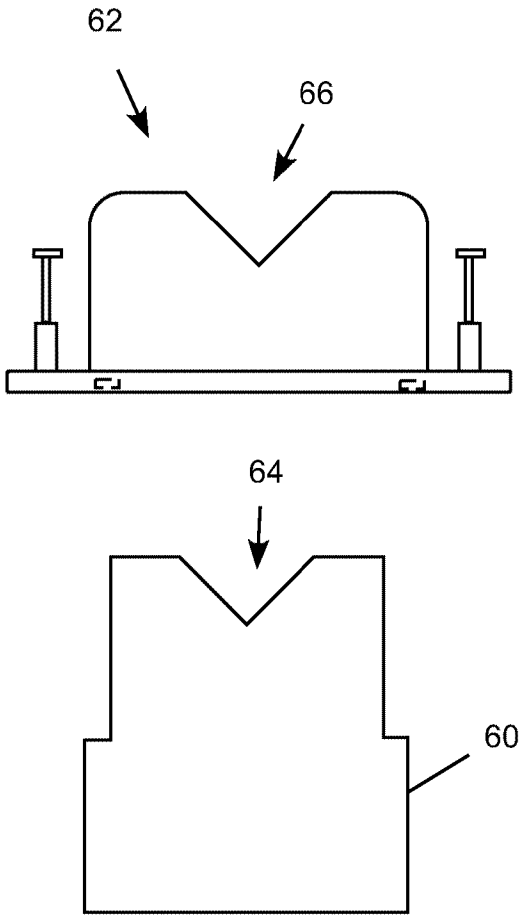
FIG. 6 is a top view of a third alternative concrete dowel device with the plate located outside the sleeve.
Figure 5:
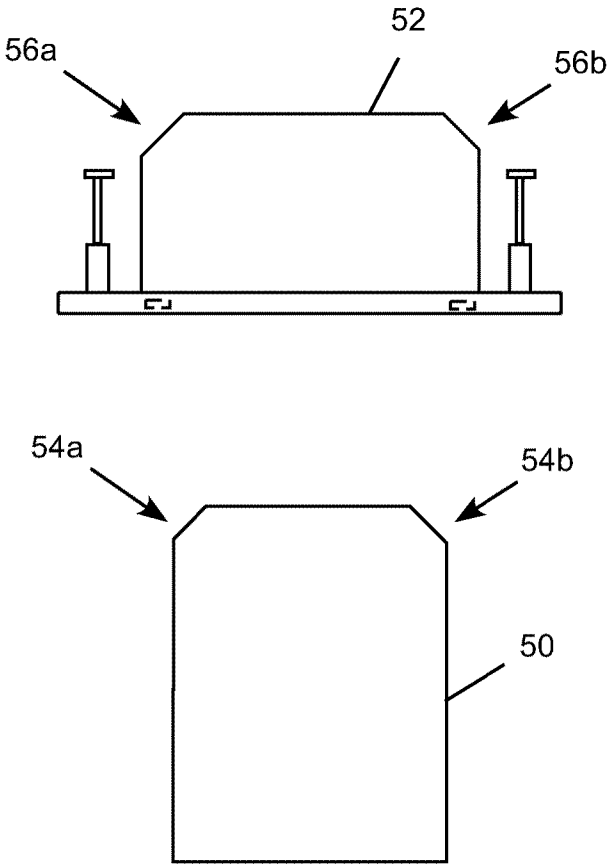
FIG. 5 is a top view of a second alternative concrete dowel device with the plate located outside the sleeve.

FIG. 5 illustrates a second alternative to ensure proper registration of the plate 50 within the sleeve 52. This alternative includes beveled corners 54*a-b* on the plate 50 configured to mate against beveled corners 56*a-b* one the sleeve 52. The beveled corners cause the plate 50 to square up as the plate 50 is forced into the sleeve 52. FIG. 6 illustrates a variation on this theme, which utilizes mating "V" groove 66 in the sleeve 62 and "V" groove guide surface 64 in the plate 60 serving the same purpose. The various registration techniques may be employed individually or combined, as desired. For example, the "V" groove alternative shown in FIG. 6 also includes the two-tiered plate configuration shown in FIGS. 4A-C.

Figure 7:
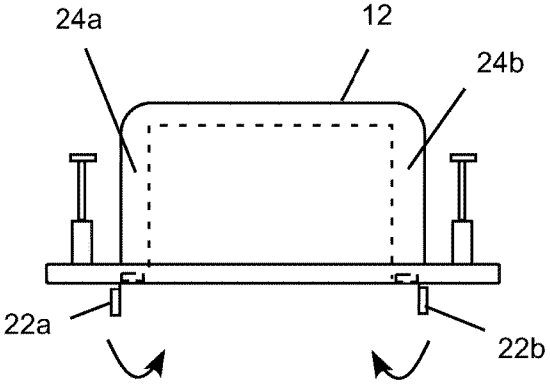
FIG. 7 is a top view of a sleeve for the concrete dowel device with break-away alignment tabs formed as molded components rotated and snapped into position.

Ease and efficiency of manufacturing is another aspect of the present invention. The undercut nature of the alignment tabs over the side portions of the socket of the sleeve could prevent the sleeve from being molded as a single part due the undercut nature of the tabs preventing easy extraction of the sleeve from the mold. To alleviate this problem, the sleeve may be configured for injection molding as a single structure with the alignment tabs pointed away from the opening of the socket with a thin, flexible seam at the junction between the tab and sleeve body and small interference structures on the tabs or sleeve body. After molding, the tabs can then be rotated and snapped into position with an interference fit as shown in FIG. 7. Small taps, grooves or ridges may be provided as interference structures to ensure a positive interference fit when the tabs are rotated and snapped into place.

Figure 8A:
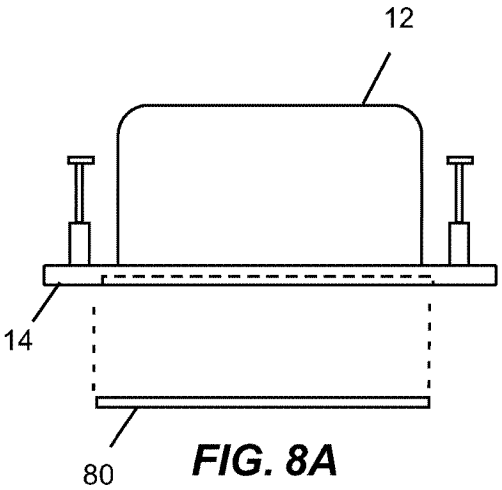
FIG. 8A is a top assembly view of an alternative sleeve design utilizing a plate insert for the break-away tabs.
Figure 8B:
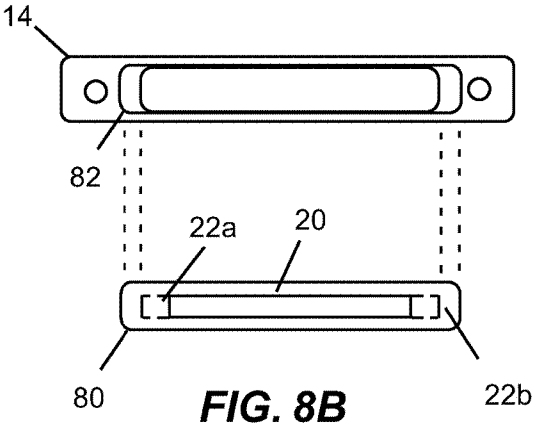
FIG. 8B is a front assembly view of the alternative sleeve design utilizing the plate insert for the break-away tabs.

Another alternative is shown in FIGS. 8A-B, in which the alignment tabs are formed as part of an insert plate 80 that is molded separately from the sleeve 12. The insert plate 80 defines the plate opening 20 flanked by the break-away alignment tabs 22*a-b* and fits within an inset area 82 in the flange 14 of the sleeve. The insert plate 80 can be secured within the inset area 82 using an interference fit, adhesive, heat seal or any other suitable attachment technique.

Although the terms "horizontal" and "vertical" have been used to describe use of the dowel in the context of a horizontal pavement, it will be appreciated that the dowel is well adapted for but not limited to the pavement application and can be used for any concrete joint of sufficient size regardless of its orientation. For example, the invention is equally applicable to joints in concrete walls, ceilings, abutments and other structures Those skilled in the art will appreciate that the foregoing describes preferred embodiments of the invention and that many adjustments and alterations will be apparent to those skilled in the art within the spirit and scope of the invention as defined by the appended claims.

The invention claimed is:

1. A concrete structure, comprising:

a first concrete slab, a second concrete slab adjacent to the first concrete slab, and a joint between the first and second concrete slabs extending in a lateral direction;

a sleeve embedded within the first concrete slab defining an opening extending in the lateral direction, a rear socket wall extending in the lateral direction spaced apart from the opening in a transverse direction perpendicular to the lateral direction, the sleeve further defining a socket extending from the rear socket wall to the opening, the sleeve further defining a flange extending in the lateral direction from the opening aligned with the joint;

a plate having a first portion extending in the lateral and transverse directions positioned in the socket of the sleeve and a second portion embedded in the second concrete slab; wherein the socket of the sleeve is wider in the lateral direction than the portion of the plate positioned in the socket;

wherein the flange of the sleeve further comprises break-away alignment tabs located at the joint on opposing sides of the opening;

wherein the alignment tabs are aligned with the joint and extend into the opening in the lateral direction;

wherein the alignment tabs are configured to reduce cracking of the slabs at the location of the sleeve by breaking away from the socket to accommodate slight movement of the first and second slabs with respect to each other along the joint in the lateral direction, said slight movement commensurate with the size of the tabs extending into the opening of the socket;

wherein the rear socket wall of the sleeve defines an indentation extending in the lateral direction toward the opening; and wherein the plate further comprises a corresponding indentation configured for mating engagement with the indentation of the rear socket wall.

2. The concrete structure of claim 1, wherein the second portion of the plate is wider than the first portion; and wherein the plate further comprises transition edges located at the interface of the wider and narrower portions positioned flush against the flange with the first portion of the plate fully inserted into the sleeve.

3. The concrete structure of claim 1 wherein the indentations in the rear socket wall and the plate are "V" shaped.

4. A concrete dowel device, comprising:

a sleeve defining an opening extending in a lateral direction, a rear socket wall extending in the lateral direction spaced apart from the opening in a transverse direction perpendicular to the lateral direction, the sleeve further defining a socket extending from the rear socket wall to the opening, the sleeve further defining a flange extending in the lateral direction from the opening configured to be embedded in a first concrete slab with the flange aligned with a joint in the lateral direction between the first concrete slab and a second concrete slab;

a plate extending in the lateral and transverse directions configured to be received within the sleeve with a first portion within the socket and a second portion extending from the socket, the second portion of the plate configured to be embedded in the second concrete slab;

wherein the socket of the sleeve is wider in the lateral direction than the first portion of the plate;

wherein the flange further comprises break-away alignment tabs on opposing sides of the opening and extending into the opening in the lateral direction;

wherein the alignment tabs are configured to reduce cracking of the slabs at the location of the sleeve by breaking away from the socket to accommodate slight movement of the first and second slabs with respect to each other along the joint in the lateral direction, said slight movement commensurate with the size of the tabs extending into the opening of the socket;

wherein the rear socket wall of the sleeve defines an indentation extending in the lateral direction toward the opening; and wherein the plate further comprises a corresponding indentation configured for mating engagement with the indentation of the rear socket wall.

5. The concrete dowel device of claim 4:

wherein the second portion of the plate is wider than the first portion; and wherein the plate further comprises transition edges located at the interface of the wider and narrower portions positioned flush against the flange with the first portion of the plate fully inserted into the sleeve.

6. The concrete dowel device of claim 5, wherein the indentations in the rear socket wall and the plate are "V" shaped.

7. A concrete dowel device, comprising:

a sleeve defining an opening extending in a lateral direction, a rear socket wall extending in the lateral direction spaced apart from the opening in a transverse direction perpendicular to the lateral direction, the sleeve further defining a socket extending from the rear socket wall to the opening, the sleeve further defining a flange extending in the lateral direction from the opening configured to be embedded in a first concrete slab with the flange aligned with a joint in the lateral direction between the first concrete slab and a second concrete slab;

a plate extending in the lateral and transverse directions configured to be received within the sleeve with a first portion within the socket and a second portion extending from the socket, the second portion of the plate configured to be embedded in the second concrete slab;

wherein the socket further comprises a rear face extending in the lateral direction spaced apart from the opening, the rear face defining a groove that indents the rear face toward the opening; and wherein the rear socket wall of the sleeve defines an indentation extending in the lateral direction toward the opening; and wherein the plate further comprises a corresponding indentation configured for mating engagement with the indentation of the rear socket wall.

8. The concrete dowel device of claim 7, wherein:

the flange further comprises break-away alignment tabs on opposing sides of the opening and extending into the opening in the lateral direction; and the alignment tabs are configured to reduce cracking of the slabs at the location of the sleeve by breaking away from the socket to accommodate slight movement of the first and second slabs with respect to each other along the joint in the lateral direction, said slight movement commensurate with the size of the tabs extending into the opening of the socket.

9. The concrete dowel device of claim 7, wherein:

the socket of the sleeve is wider than the first portion of the plate; and the second portion of the plate is wider than the opening of the socket and comprises transition edges configured to be received flush against the flange of the sleeve when the plate is fully inserted into the socket.

10. The concrete dowel device of claim 7, wherein the indentations in the rear socket wall and the plate are "V" shaped.

* * * * *